US005226796A

United States Patent [19]

Okamoto et al.

[11] Patent Number: 5,226,796

[45] Date of Patent: Jul. 13, 1993

[54] VALVE ASSEMBLY IN A PISTON TYPE COMPRESSOR

[75] Inventors: Takashi Okamoto; Atsushi Fukaya; Katsunori Kawai; Hayato Ikeda, all of Kariya, Japan

[73] Assignee: Kabushiki Kaisha Toyoda Jidoshokki Seisakusho, Kariya, Japan

[21] Appl. No.: 782,660

[22] Filed: Oct. 25, 1991

[30] Foreign Application Priority Data

Oct. 29, 1990 [JP] Japan ..... 2-292618

[51] Int. Cl.[5] ..... F04B 39/10

[52] U.S. Cl. ..... 417/571; 417/570; 137/856

[58] Field of Search ..... 417/569, 570, 571; 137/855, 856

[56] References Cited

U.S. PATENT DOCUMENTS 4,911,614 3/1990 Kawai et al. ..... 417/571

4,936,754 6/1990 Suzuki et al. ..... 417/571

5,062,779 10/1991 Da Costa ..... 137/856

*Primary Examiner*—Richard A. Bertsch

*Assistant Examiner*—Charles G. Freay

*Attorney, Agent, or Firm*—Brooks Haidt Haffner & Delahunty

[57] ABSTRACT

A valve assembly in a piston type refrigerant compressor is disclosed. The valve assembly includes a retainer formed integrally with a gasket plate for restricting the opening of a discharge reed valve of the compressor, and having on opposite sides at the distal portion thereof stay portions integral with the gasket plate for rigidly holding the retainer. According to the present invention, provision is made to guide some part of the refrigerant gas compressed in a cylinder bore to be discharged into a discharge chamber in such a way that the influence of the discharge gas pressure on the retainer at its distal end is reduced. In some embodiments of the invention, this is accomplished by guiding and allowing part of the gas to flow toward the proximal portion of the retainer to discharge the gas.

17 Claims, 11 Drawing Sheets

VALVE ASSEMBLY IN A PISTON TYPE COMPRESSOR

FIELD OF THE INVENTION

The present invention relates to a valve assembly for use in a piston type refrigerant compressor for an air-conditioning system. More specifically, it relates to a valve assembly in the above compressor which is designed to prevent damage of a valve retainer in the valve assembly that would otherwise result from application of high pressures of compressed refrigerant gas being discharged from a cylinder bore into a discharge chamber through an outlet port in the valve assembly.

BACKGROUND OF THE INVENTION

In a refrigerant compressor wherein a piston slidably received in a cylinder bore is operable on refrigerant gas for compression and the compressed gas is discharged through an outlet port while pushing, or springing out a flexible reed valve normally closed over the port, the pressure built up in the cylinder bore during gas discharging depends on resistance against the flow of gas through the outlet port. To establish the discharged gas pressure at a desired value, a retainer is usually provided in the compressor for restricting the maximum opening of the discharge reed valve. In operation, the discharge reed valve is opened when the gas pressure in the cylinder bore is increased above a predetermined value and the reed valve opening movement is stopped by the retainer.

A valve retainer for restricting the opening of a discharge reed valve is disclosed, for example, in the Publication of Unexamined Japanese Patent Application 60-209674 (1985). This retainer is formed as an integral part of a circular gasket plate mounted between an end housing of the compressor and a valve plate. The retainer portion of the gasket plate is formed as a slightly raised portion with a slant extending from its base portion lying in the plane of the gasket plate toward its radially outward distal end so as to conform to the "sprung-out" shape of the discharge reed valve when fully opened. The gasket plate is formed also with a slit-shaped aperture adjacently to the distal end of the retainer portion, providing a relatively large space or passage for allowing compressed gas to flow therethrough toward a discharge chamber. The retainer portion is held in its raised position by a pair of lateral support or stay portions formed as an integral part of the gasket plate on opposite sides of the distal end portion of the retainer, so that a clearance is formed on each side of the base portion of the retainer through which part of the compressed refrigerant gas may escape. It is noted, however, that most of the compressed gas comes out of the cylinder bore through the slit-shaped aperture adjacent to the distal end of the retainer.

The gasket plate, in which the retainer is formed integrally therewith, is made as thin as possible for the sake of lightweightness of the compressor and, therefore, the retainer is held in position by the above paired stay portions having a relatively thin structure. That is, high pressure of the compressed refrigerant gas received by the retainer is transmitted inevitably to the stay portions. Application of such high pressure causes harmful stresses in the retainer, particularly at outer edges of the stay portions, with the result that damage or breakage may occur at such locations of the retainer.

SUMMARY OF THE INVENTION

It is an object of the present invention, therefore, to provide a valve assembly in a piston type refrigerant compressor which can reduce the influence of gas pressure on the stay portions for the retainer.

A valve assembly of the invention includes a valve plate forming therein a discharge port through which refrigerant gas compressed in the cylinder bore is force out toward the discharge chamber, a flexible discharge reed valve attached to the valve plate on the side of the discharge chamber and arranged to normally close the discharge port and swingable about the proximal base portion thereof away from the valve plate to open the discharge port, and a plate member disposed on the discharge reed valve and forming therein a retainer portion contactable by the discharge reed valve in its fully swung position for restricting the opening thereof. The retainer portion is formed as a raised portion of the plate member extending with a slight curve toward the discharge chamber from the proximal portion thereof integrally connected with the plate member so as to conform to the discharge reed valve in its fully opened position and having on opposite sides at the distal portion thereof stay portions integral with the plate member for rigidly holding the retainer portion in a position raised from the plate member. The plate member is formed adjacent to the distal end of the retainer portion with an elongated aperture extending laterally beyond the stay portions for providing a gas passageway allowing the refrigerant gas compressed in the cylinder bore to flow toward the discharge chamber.

In the first and second embodiments of the invention, the valve plate has formed therein at least one cavity which provides a gas passageway guiding part of the refrigerant gas toward the proximal portion of the retainer portion and then into the discharge chamber.

In the third embodiment of the invention, the retainer portion has formed therein an aperture which is closable by the discharge reed valve when fully opened and provides a gas passageway guiding part of the refrigerant gas compressed in the cylinder bore toward said discharge chamber while the discharge reed valve is halfway between the closed and opened positions thereof.

In the fourth embodiment, the paired stay portions are formed progressively wider laterally outwardly toward the proximal portion of the retainer portion so that a space is available which is large enough to guide part of the refrigerant gas toward the proximal portion of the retainer.

In any of the above embodiments, some part of the refrigerant gas compressed in the cylinder bore is guided toward the proximal portion of the retainer and flows into the discharge chamber while the remaining part of the gas is discharged through the elongated aperture at the opposite distal end of the retainer. Thus, the influence of discharge pressure on the outer edges of the stay portions can be reduced by allowing part of the gas to flow in other ways and, therefore, damage to the retainer can be prevented.

In the fifth embodiment, the elongated aperture is enlarged at the opposite ends thereof in the area of the stay portions toward the proximal portion of the retainer. The enlarged ends of the gas passage aperture in this embodiment serve to disperse the stresses thereby to reduce the influence of the discharge pressure on the retainer stay portions.

The above objects, features and advantages of the present invention will become apparent to those skilled in the art from the following description of embodiments according to the invention, which description is made with reference to the accompanying drawings, wherein:

DETAILED DESCRIPTION OF THE EMBODIMENTS

The following will describe the first embodiment of valve assembly as used in a multi-cylinder swash plate type compressor while referring to FIGS. 1 to 4.

Figure 1:
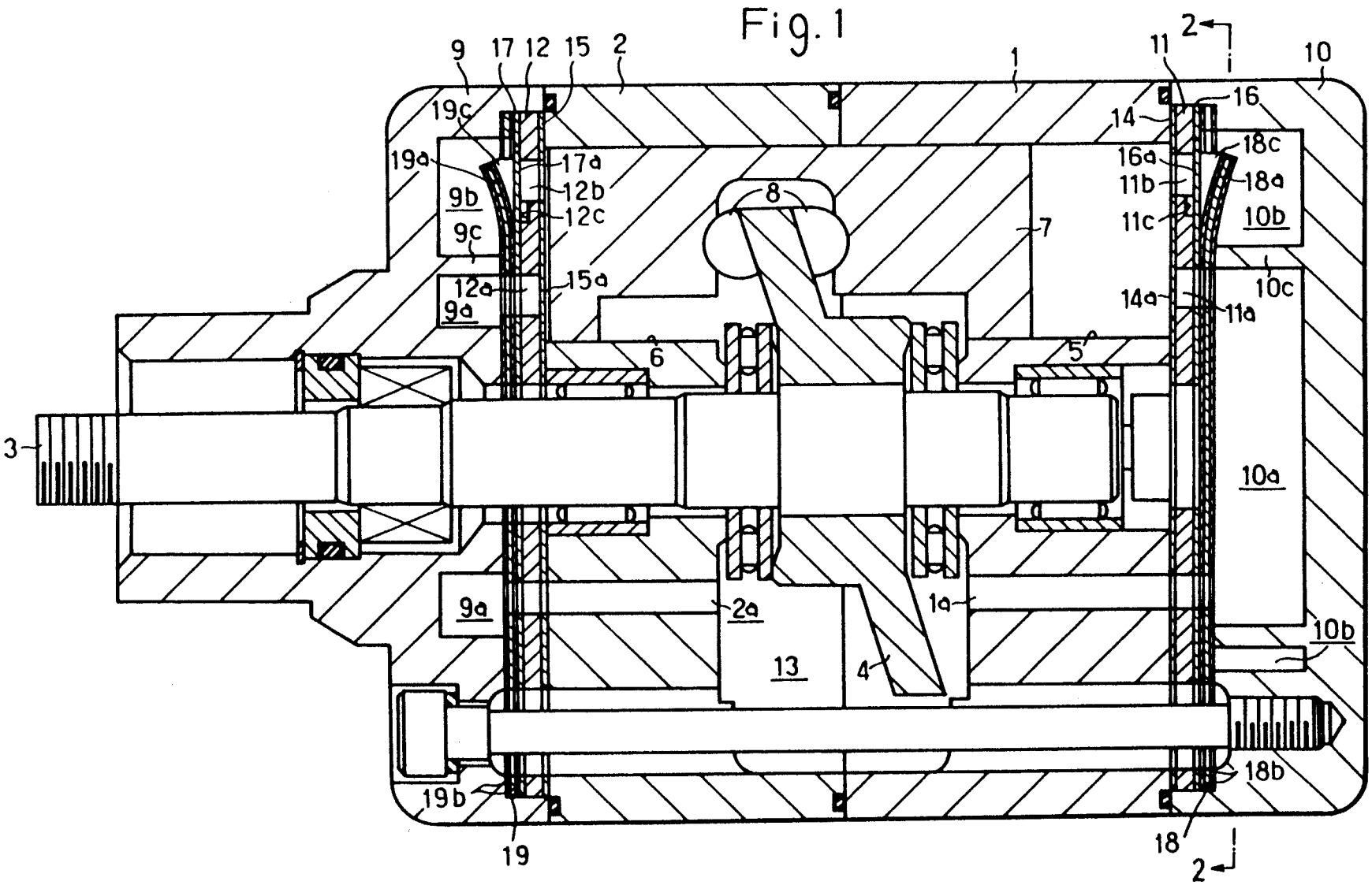
FIG. 1 is a longitudinal sectional view illustrating a multi-cylinder swash plate type compressor incorporating therein a valve assembly constructed according to the present invention.
Figure 2:
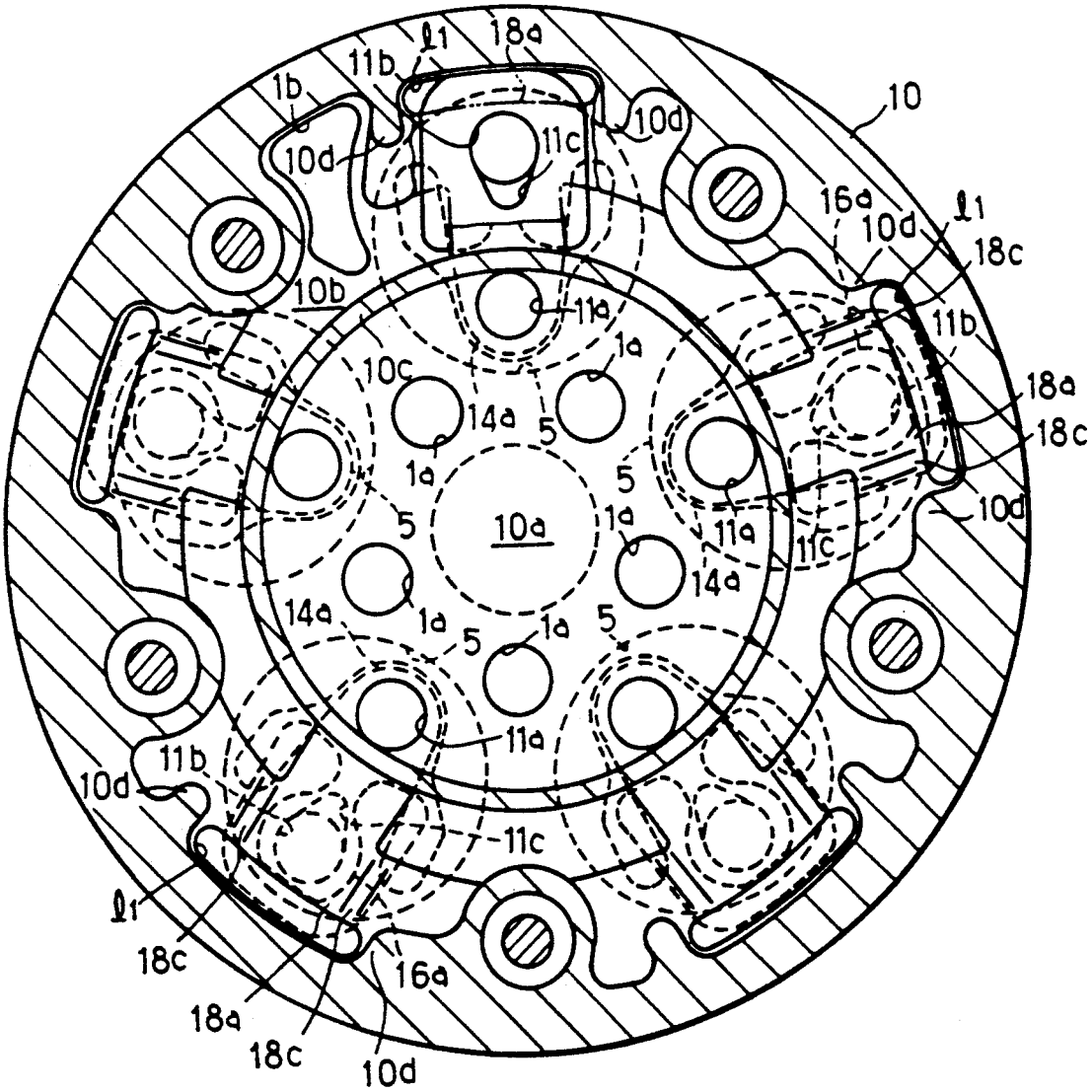
FIG. 2 is a transverse sectional view taken along line 2—2 of FIG. 1.

Referring firstly to FIG. 1, there is illustrated a multi-cylinder swash plate type refrigerant compressor provided with a valve assembly constructed according to the present invention. The compressor includes front and rear cylinder blocks 2, 1 sealingly combined together to form a cylinder block assembly. The front and rear cylinder blocks 2, 1 cooperate to define therein a compartment 13 for accommodating a circular swash plate 4 which is fixedly mounted on a drive shaft 3 which is received in central axial bores in the block assembly in alignment with each other and supported rotatably by a pair of radial bearings. The swash plate 4 is fixed on the drive shaft 3 at a predetermined angle of inclination so that the plate makes a wobbling movement in the compartment 13 when it is driven to rotate by the drive shaft 3. The cylinder block assembly has formed therein a desired number of pairs of front and rear cylinder bores 6, 5 which are equally angularly spaced around and in parallel to the drive shaft 3. The front and rear cylinder bores 6, 5 of each pair receive therein a double-headed piston 7 mounted for reciprocal axial sliding movement in the bores. Each piston 7 is held to the swash plate 4 by way of a pair of front and rear hemispherical shoes 8 in such a way that the wobbling movement of the swash plate 4 is converted into the reciprocal axial sliding movement of the piston 7 in its corresponding cylinder bores 6, 5.

The front end of the combined cylinder block assembly is closed by a front housing 9 via a valve assembly, and the rear end of the cylinder block assembly is closed by a rear housing 10 via a similar valve assembly, respectively. The front and rear housings 9, 10 cooperate with their associated valve assemblies to form suction chambers **9*a*, 10*a* and discharge chambers 9*b*, 10*b* separated from each other by partitioning walls 9*c*, 10*c*, respectively. Both suction chambers 9*a*, 10*a* in the front and rear housings 3, 4 communicate with the swash plate compartment 13 through suction passages 2*a*, 1*a*, respectively. The front valve assembly between the front housing 9 and cylinder block 2 has a general circular shape and includes a valve plate 12 having formed therein an inlet or suction port 12*a* and an outlet or discharge port 12*b* for each cylinder bore 6, a thin plate 15 disposed between the cylinder block 2 and the valve plate 12 and forming an integral suction reed valve 15*a* operable to open and close the suction port 12*a*, another thin plate 17 attached on the opposite side of the valve plate 12 and forming an integral discharge reed valve 17*a* operable to open and close the discharge port 12*b*, and a gasket plate 19 provided between the discharge reed valve plate 17 and the front housing 9 and forming an integral retainer 19*a* for the discharge reed valve 17*a*. The rear valve assembly on the opposite side of the compressor between the rear housing 10 and rear cylinder block 1 has substantially identical elements including a valve plate 11 with a suction port 11*a* and a discharge port 11*b* for each cylinder bore 5, thin plates 14, 16 forming a suction reed valve 14*a* and a discharge reed valve 16*a*, respectively, for each cylinder bore, and a gasket plate 18 forming a retainer 18*a* for the discharge reed valve 16*a*. The suction chambers 9*a*, 10*a* are communicable with the cylinder bores 6, 5 through the suction ports 12*a*, 11*a* in the valve plates 12, 11, respectively. The discharge chambers 9*b*, 10*b* are communicable with the cylinder bores 6, 5 through the discharge ports 12*b*, 11*b* in the valve plates 12, 11**, respectively.

Since the arrangement of the front and rear valve assemblies are identical except that one is in reversed position with respect to the other, the following description will be made with reference to the valve assembly provided on the rear side of the compressor.

Figure 3:
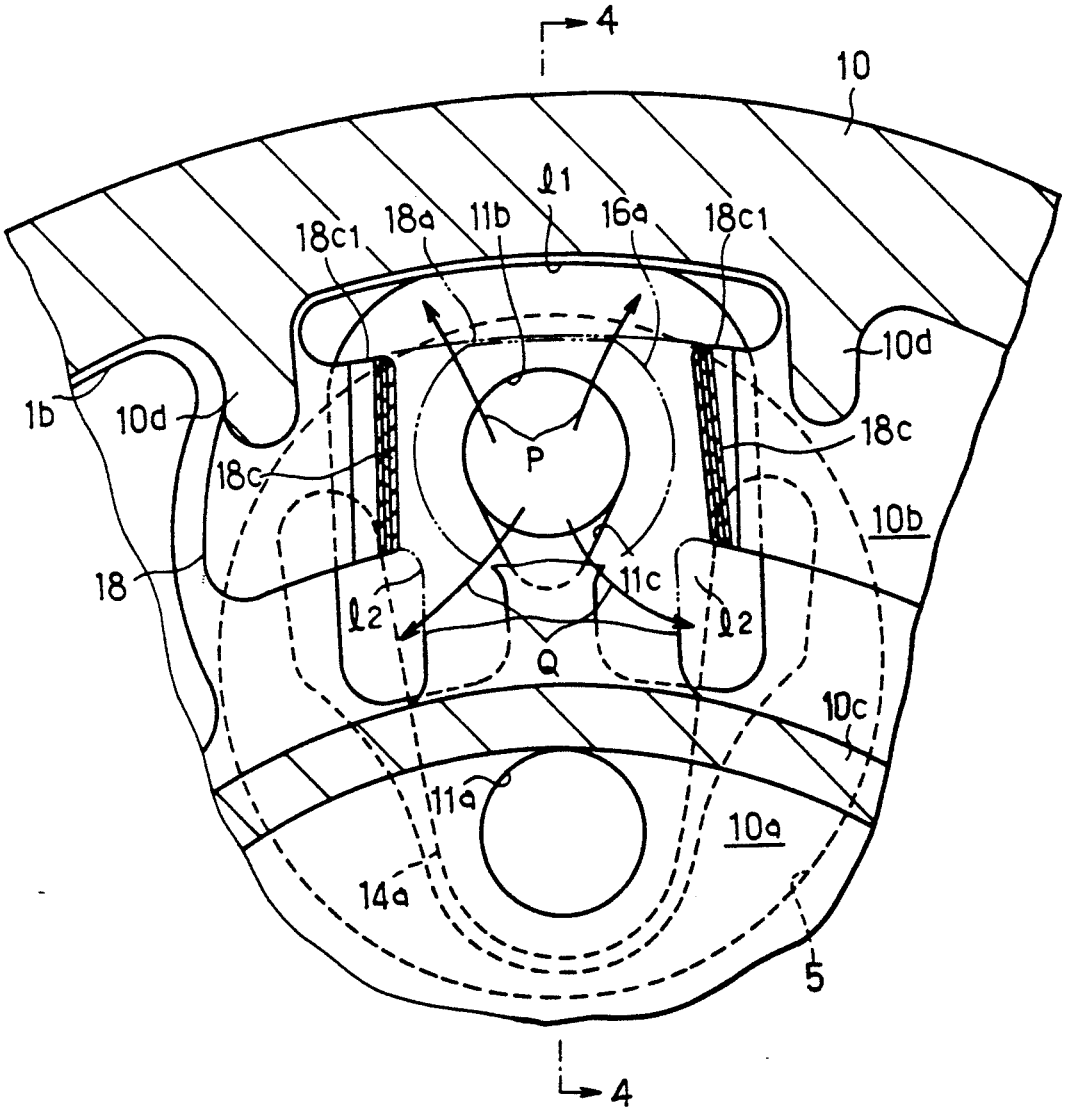
FIG. 3 is a fragmental enlarged sectional view showing a part of the valve assembly for each cylinder bore as seen from a discharge chamber of the compressor.
Figure 4:
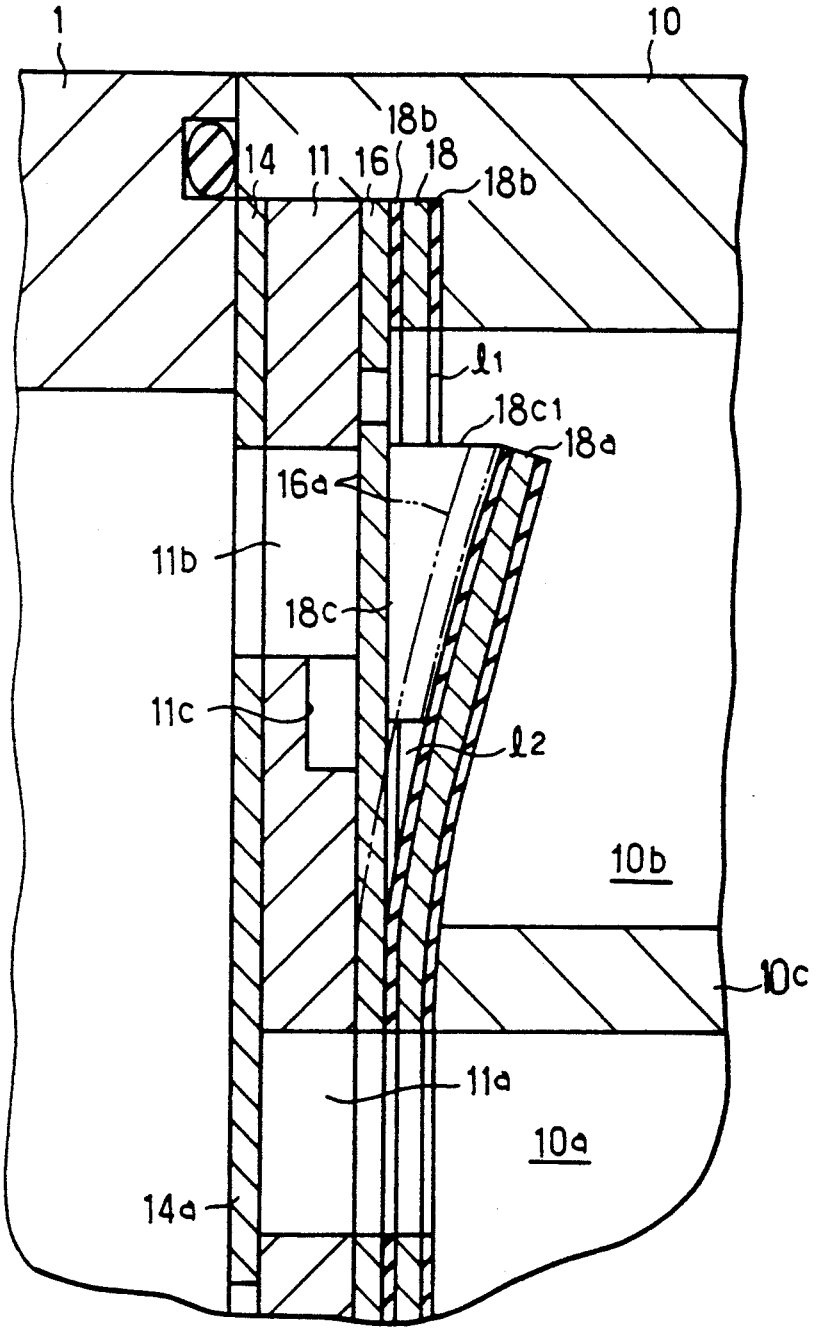
FIG. 4 is a sectional view taken along line 4—4 of FIG. 3.

The gasket plate 18 is made of a thin steel plate coated on both sides thereof with films **18*b* made of resilient material such as rubber, as indicated by bold shading in FIGS. 1 and 4. The retainer portion 18*a* is provided in the gasket plate 18 integrally therewith. It is formed as a slightly raised portion slanting from its base lying in the plane of the gasket plate 18 toward its radially outward distal end so as to restrict the maximum opening of the discharge reed valve 16*a*, as shown by phantom line in FIG. 4. The gasket plate is formed with a slit-shaped opening or aperture 11 just radially outward of the distal end of the retainer 18*a*, as a compressed refrigerant gas passageway between the discharge port 11*b* and the discharge chamber 10*b*. As seen most clearly in FIGS. 2 and 3, the radially outer side of the aperture 11 is blocked by the inner wall of the housing 10, and the gasket plate 18 is held down at the opposite ends of the aperture by projections 10*d* formed as part of the inner wall of the housing 10 to prevent the retainer 18*a* from being floated outward by the discharge gas pressure. Thus, the aperture 11 is partially surrounded by the inner wall of the housing 10**.

The retainer 18*a* is held rigidly in its raised position by a pair of lateral stay portions 18*c* formed as integral parts of the gasket plate 18 and extending from opposite sides of the distal portion of the retainer integrally to the plane of the gasket plate. Accordingly, a clearance l2 is formed in the region adjacent to the base portion of the retainer 18*a* between the raised retainer portion 18*a* of the gasket plate 18 and the reed valve plate 16 and the space therebetween is partially enclosed by the stay portions 18*c*.

As most clearly seen in FIGS. 3 and 4, the valve plate 11 is formed at part of an area thereof contactable with the discharge reed valve 16*a* with a tongue-shaped cavity 11*c* as a refrigerant gas guide passageway in direct communication with the discharge port 11*b*. The gas guide passageway 11*c* extends from part of the circumferential edge of the discharge port 11*b* toward the proximal end of the discharge reed valve 16*a*. The guide passageway 11*c* is closed by the discharge reed valve 16*a*, but establishes such direct communication between the discharge port 11*b* and the discharge chamber 10*b* via the clearances l2 when the reed valve 16*a* is opened as shown by phantom line in FIG. 4, that provides a passageway through which part of the compressed refrigerant gas can escape into the discharge chamber 10*b*.

In operation of the compressor, low pressure refrigerant gas is drawn from the suction chamber 10*a* into the cylinder bore 5 through the suction port 11*a*, then compressed in the cylinder bore, and the compressed and hence high pressure gas is forced out into the discharge chambers 10*b* through the outlet port 11*b* while springing up the discharge reed valve 16*a* to open. The refrigerant gas thus discharged is fed via a passageway 1*b* to an external refrigerant circuit (not shown).

This alternate drawing and discharging of refrigerant gas causes the discharge reed valve 16*a* to move between the valve plate 11 and the retainer 18*a* in alternate directions repeatedly. The compressed refrigerant gas of high pressure flows out through the discharge port 11*b* into the discharge chamber 10*b* as indicated by arrows P and Q, wherein the arrows P represent gas flow through the slit-shaped aperture l1 and the arrows Q depict gas flow through the guide cavity 11*c* and the clearance l2. As it would be now apparent, part of the compressed refrigerant gas flowing through the discharge port 11*b* is guided by the cavity 11*c* toward the base portion of the retainer 18*a*.

If it were not for the cavity 11*c*, most of the gas being would be discharged through the passageway l1, with only a small amount of gas allowed to flow through the clearances l2. Because downstream side of the passageway l1 is blocked by the housing 10, gas flowing out of the passageway is not very smooth. Additionally, because the gasket plate 18 is held down adjacent to the opposite ends of the passageway l1 by the projections 10*d* of the housing 10, stresses caused by the discharge gas pressure tends to be concentrated on edges 18*c*1 of the stay portions 18*c* adjacent to the distal end of the retainer 18*a*. Such concentration of stresses may cause breakage of the retainer 18*a* at the edges 18*c*1.

In the above-illustrated embodiment, however, the cavity 11*c* functions to guide part of the refrigerant gas to flow toward the discharge chamber 10*b* through the clearances l2, thus permitting rapid flowing of the gas into the discharge chamber. The gas pressure acting on the retainer 18*a* via the discharge reed valve 16*a* is thus decreased, with the result that damaging concentration of stresses in the retainer 18*a* at the edges 18*c*1 of the stay portions 18*c* is prevented, thereby forestalling breakage of the retainer 18*a*.

Figure 5:
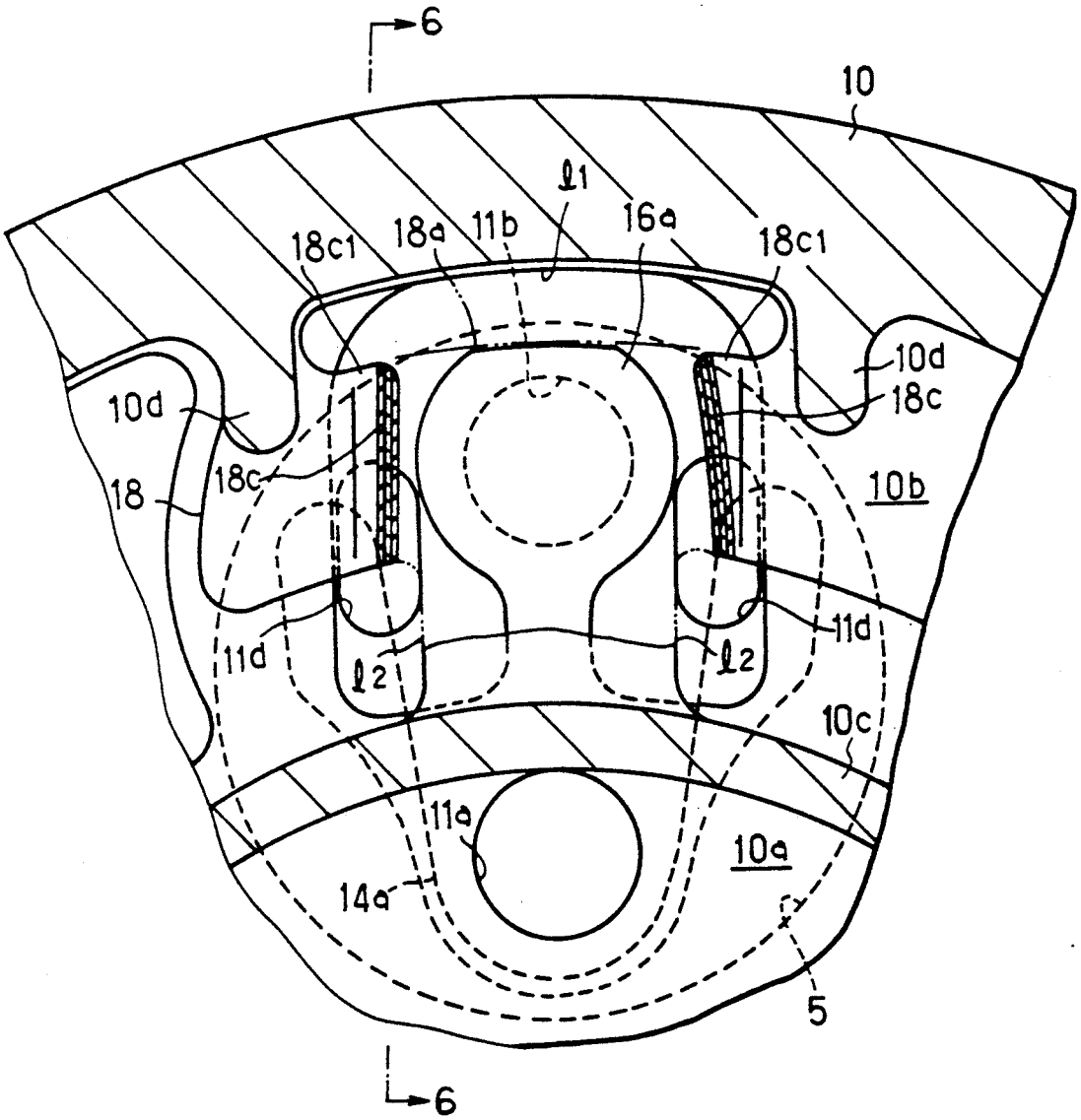
FIG. 5 is a fragmental enlarged sectional view showing second embodiment of the present invention.
Figure 6:
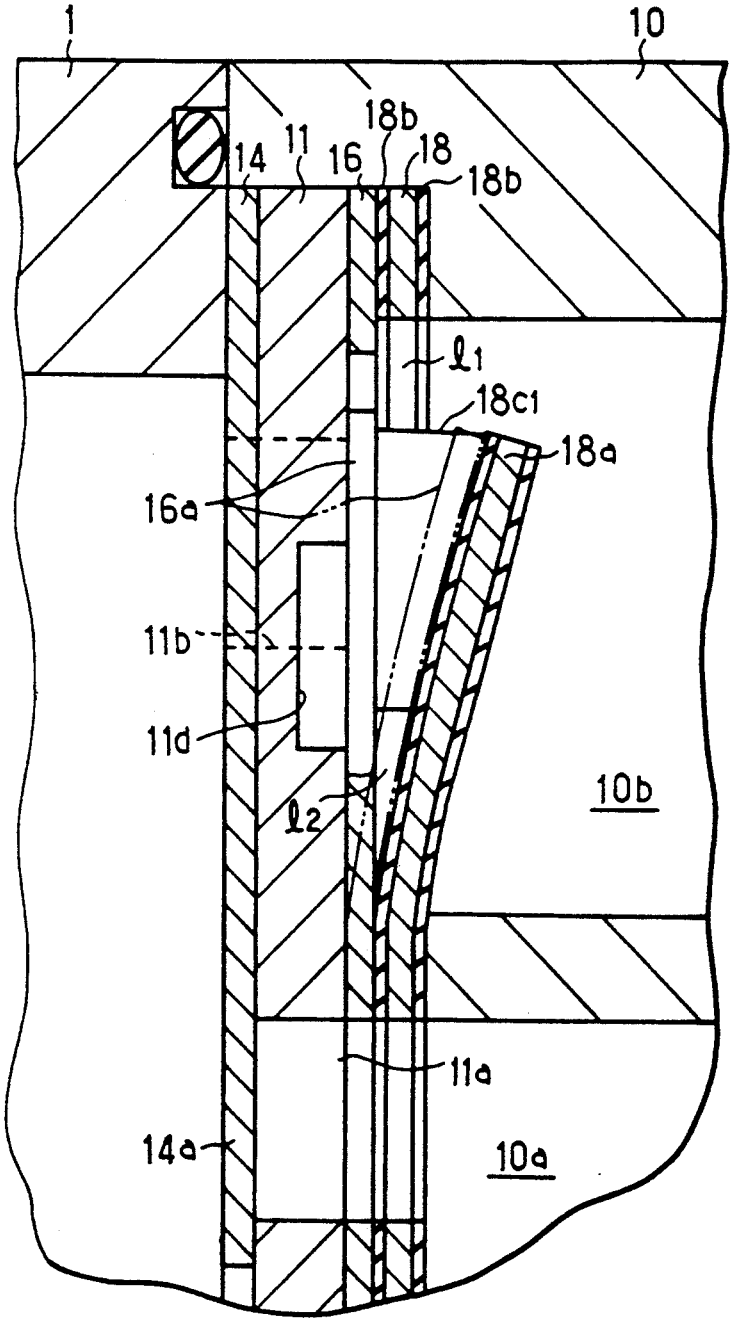
FIG. 6 is a sectional view taken along line 6—6 of FIG. 5.

Reference is now made to FIGS. 5 and 6 showing the second embodiment of the invention. This embodiment differs from the first embodiment in that a pair of cavities 11*d* as guide passageways is formed in the valve plate 11 in place of the cavity 11*c* in the latter embodiment. Unlike the cavity 11*c* formed in direct communication with the discharge port 11*b*, the guide passageway cavities 11*d* are formed in the valve plate 11 on opposite sides of the base portion of the discharge reed valve 16*a* outside the area where the reed valve 16 is contactable with the valve plate 11, as seen most clearly in FIG. 5, so that parts of the respective cavities 11*d* are exposed to the discharge chamber 10*b*. Though the cavities 11*d* are not in direct communication with the discharge port 11*b*, they establish fluid communication that guides and allows part of the compressed refrigerant gas to escape through the clearances l2 into the discharge chamber 10*b*.

Figure 7:
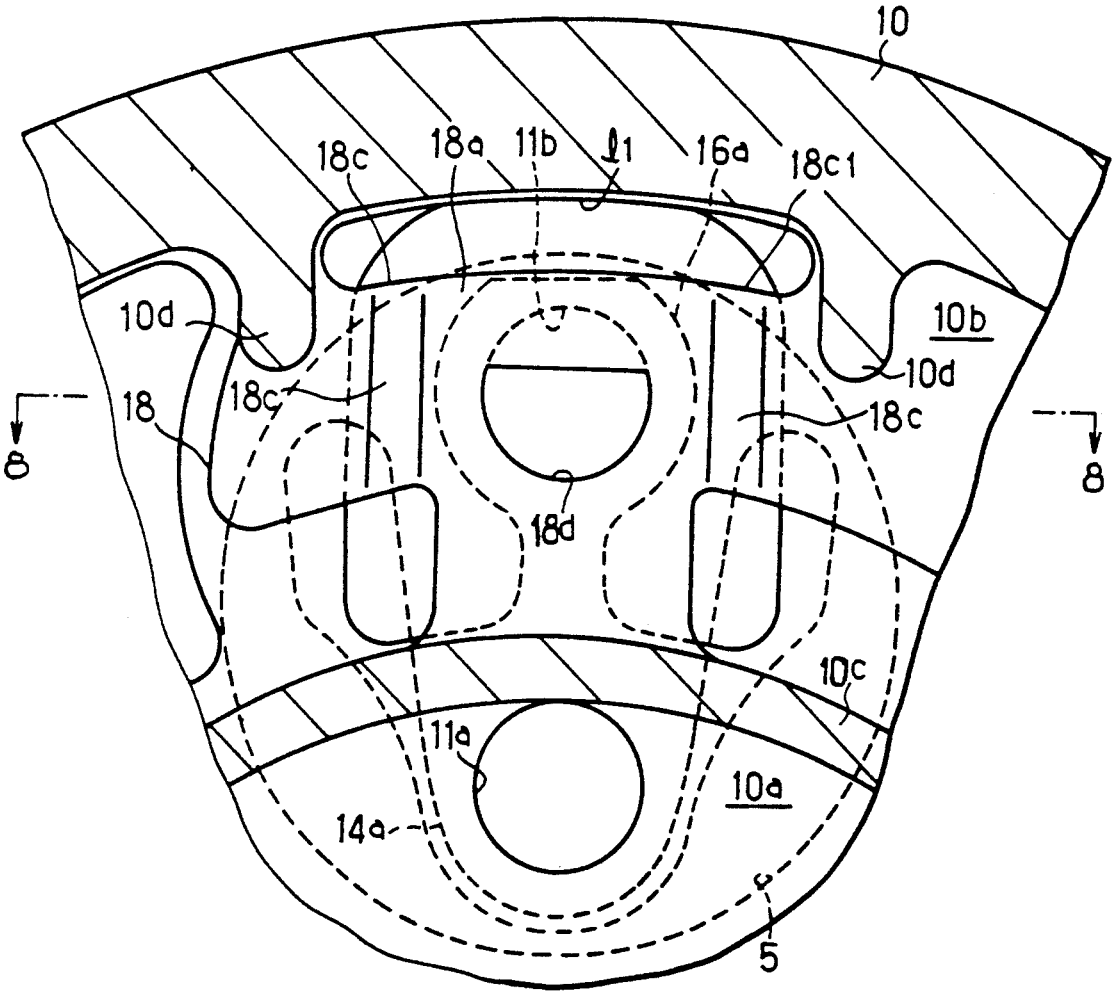
FIG. 7 is a fragmental enlarged sectional view showing third embodiment of the invention.
Figure 8:
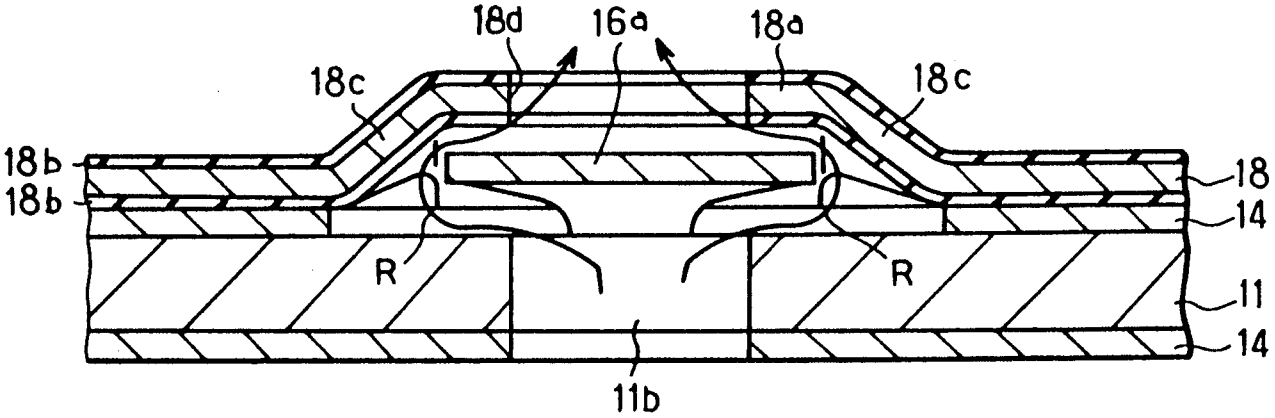
FIG. 8 is a sectional view taken along line 8—8 of FIG. 7.

Referring to FIGS. 7 and 8 illustrating the third embodiment, no guide cavities such as the cavities 11*c* and 11*d* formed in the valve plate 11 in the above first and second embodiments, respectively, are provided, but an aperture 18*d* is formed through the retainer 18*a* as a guide passageway. This guide passageway aperture 18*d* is segment shaped as shown in FIG. 7 to secure a solid portion in the retainer between the slit-shaped aperture l1 and the gas guide aperture 18*d* in the retainer is located so as to substantially coincide with the opening of the discharge port 11*b*. The aperture is closed by the discharge valve reed 16*a* when the latter is opened to its retained position. In operation, part of the compressed refrigerant gas is allowed to flow through this gas flow guide aperture 18*d* into the discharge chamber 10*b*, as indicated by arrows R in FIG. 8, only during the period of time before the aperture 18*d* in the retainer 18*a* is closed by the discharge reed valve 16*a*. Though the period of time during which the gas flow indicated by R takes place is shorter in comparison with the first and second embodiments, the damaging action of the discharge pressure on the retainer may be reduced to relieve the stress produced in the retainer 18*a* at its distal edges 18*c*1.

Figure 9:
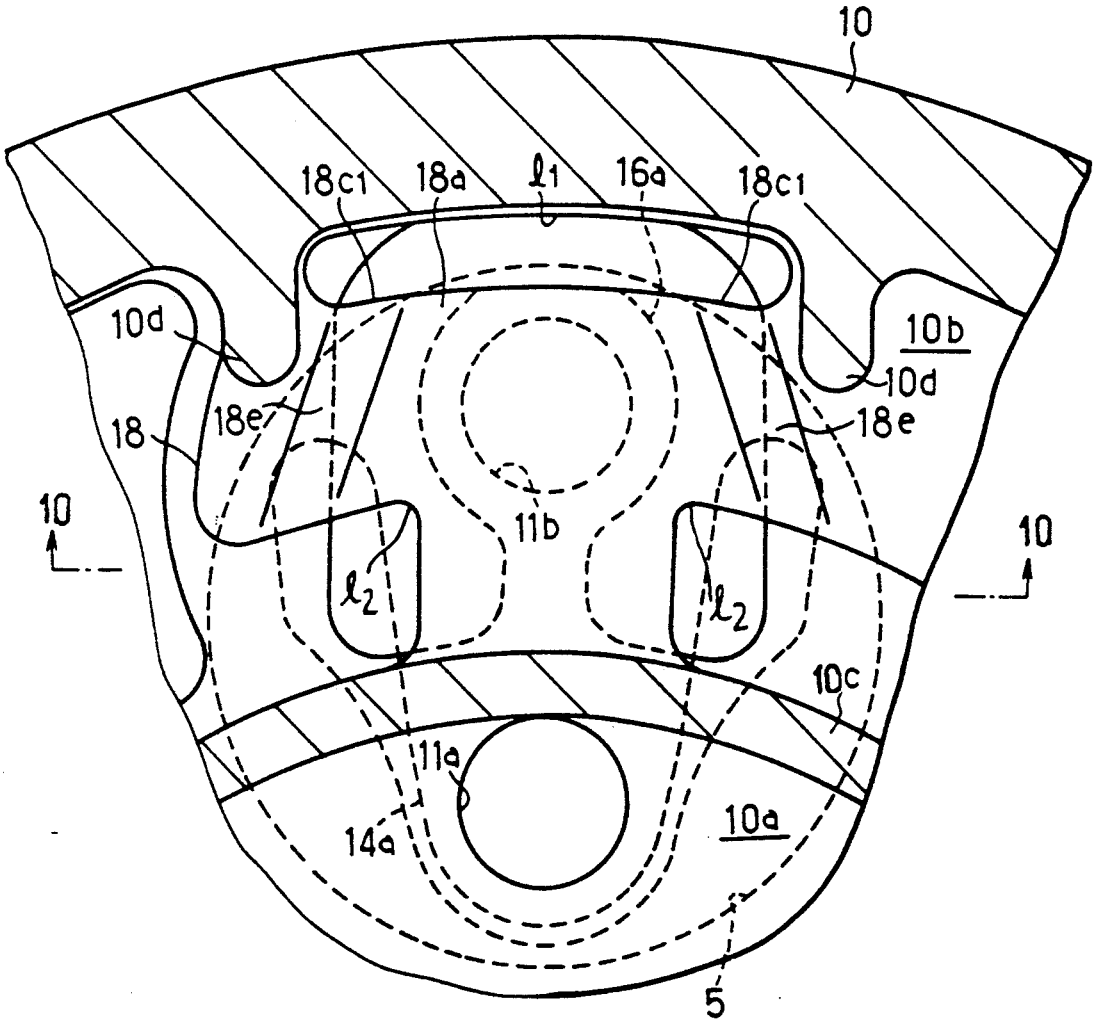
FIG. 9 is a fragmental enlarged sectional view showing fourth embodiment of the invention.
Figure 10:
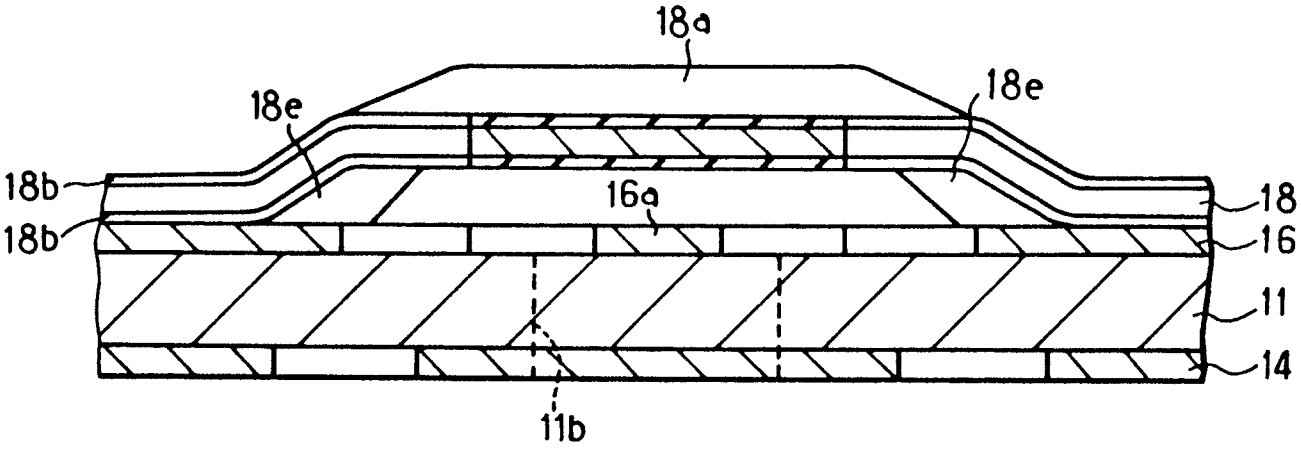
FIG. 10 is a sectional view taken along line 10—10 of FIG. 9.

Reference is now made to FIGS. 9 and 10 showing the fourth embodiment of the present invention. The feature of this embodiment lies in that the distance between the opposite stay portions 18*e* of the retainer 18*a* are widened toward the base of the retainer so that the sectional area of the clearance l2 is enlarged. Thus enlarging the sectional area of the clearance l2 can facilitate the flow of part of the refrigerant gas discharged through the outlet port 11*b* toward the proximal base portion of the retainer 18*a*, thereby reducing the volume of refrigerant gas flowing toward the distal end of the retainer.

Figure 11:
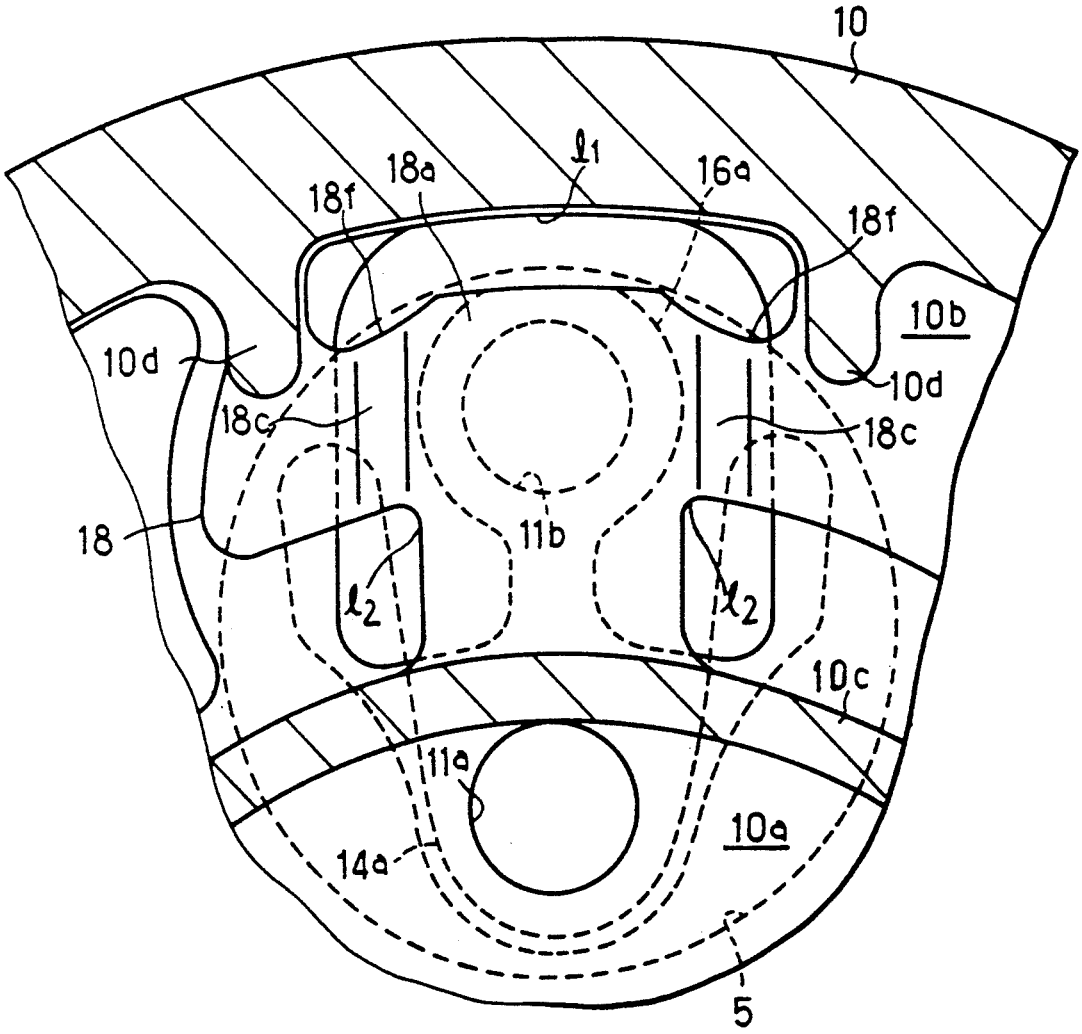
FIG. 11 is a fragmental enlarged sectional view showing fifth embodiment of the invention.

Referring to FIG. 11 showing the fifth embodiment of the present invention, the slit-shaped aperture l1 formed in the gasket plate 18 is broadened in such a way at its opposite ends 18*f* that the broadened area covers the distal ends 18*c*1 of stay portions 18*c*. Such enlarged ends 18*f* of the slit l1 helps to disperse the stresses produced at the distal ends of the stay portions, thereby preventing breakage to the retainer 18*a*. Additionally, provision of the broadened ends 18*f* to the aperture l1 increases the sectional area of the aperture l1, thereby permitting smoother flow of compressed refrigerant gas to relieve the concentration of stresses produced in the retainer 18*a*.

While the invention has been described and illustrated with reference to the specific embodiments, it is to be understood that the invention can be changed or modified in various other ways without departing from the spirit or scope thereof, for example, application of the present invention to a piston type compressor having discharge chambers inside the compressor and also to other piston type compressors than the swash plate compressor.

What is claimed is:

1. A valve assembly in a piston type refrigerant compressor having a cylinder block assembly forming therein an axially extending cylinder bore, a reciprocable piston slidably received in said cylinder bore, a housing clamped to an axial end of said cylinder block assembly with said valve assembly therebetween and having formed therein a discharge chamber communicable with said cylinder bore, said valve assembly including a substantially flat-surfaced valve plate having formed therein a discharge port through which refrigerant gas compressed in the cylinder bore is forced out toward said discharge chamber, a flexible discharge reed valve attached to said valve plate on the side thereof facing the discharge chamber and arranged to normally close said discharge port and swingable about a proximal base portion thereof away from the valve plate to open said discharge port, and a plate member disposed on said discharge reed valve and having formed therein a retainer portion contactable by said discharge reed valve in its fully opened position for restricting the opening thereof, said retainer portion being formed as a raised portion of said plate member having a proximal portion and a distal portion and slanting therebetween in direction toward the discharge chamber from said proximal portion thereof which is integrally connected to the plate member so as to conform to said discharge reed valve in its fully opened position and having on opposite sides at said distal portion thereof stay portions which are integral with the plate member for rigidly holding said retainer portion in said position raised from the plate member, said stay portions each having clearance opening therethrough adjacent to said proximal portion of said raised portion, wherein said valve plate has formed therein at least one cavity which provides a gas passageway for guiding part of the refrigerant gas compressed in the cylinder bore toward said proximal portion of said retainer portion and then into said discharge chamber at least in part via said stay portion clearance openings.

2. A valve assembly according to claim 1, wherein said gas passageway is provided by a cavity in the valve plate in direct communication with said discharge port and extending therefrom toward said proximal base portion of said discharge reed valve within the area where the reed valve is contactable with said valve plate.

3. A valve assembly according to claim 1, wherein said gas passageway is provided by a pair of cavities in the valve plate on opposite sides of said proximal base portion of said discharge reed valve outside the area where the reed valve is contactable with said valve plate.

4. A valve assembly according to claim 1, wherein said plate member is formed adjacently to the distal end of said retainer portion with a slit-shaped aperture through which the refrigerant gas compressed in the cylinder bore may flow toward said discharge chamber.

5. A valve assembly according to claim 1, wherein said plate member is provided by a gasket plate and said discharge reed valve is formed as an integral portion of a thin plate interposed between said valve plate and said gasket plate.

6. A valve assembly according to claim 1, wherein said compressor is of a multi-cylinder swash plate type refrigerant gas compressor.

7. A valve assembly in a piston type refrigerant compressor having a cylinder block assembly forming therein an axially extending cylinder bore, a reciprocable piston slidably received in said cylinder bore, a housing clamped to an axial end of said cylinder block assembly with said valve assembly therebetween and having formed therein a discharge chamber communicable with said cylinder bore, said valve assembly including a valve plate having formed therein a discharge port through which refrigerant gas compressed in the cylinder bore is forced out toward said discharge chamber, a flexible discharge reed valve attached to said valve plate on the side thereof facing the discharge chamber and arranged to normally close said discharge port and swingable about a proximal base portion thereof away from the valve plate to open said discharge port, and a plate member disposed on said discharge reed valve and having formed therein a retainer portion contactable by said discharge reed valve in its fully opened position for restricting the opening thereof, said retainer portion being formed as a raised portion of said plate member having a proximal portion and a distal portion and slanting therebetween in direction toward the discharge chamber from said proximal portion thereof which is integrally connected to the plate member so as to conform to said discharge reed valve in its fully opened position and having on opposite sides at said distal portion thereof stay portions integral with the plate member for rigidly holding said retainer portion in said position raised from the plate member, wherein an aperture is formed in said retainer portion which is closable by said discharge reed valve when fully opened and provides a gas passageway guiding part of the refrigerant gas compressed in the cylinder bore toward said discharge chamber while the discharge reed valve is moving between the closed and opened positions thereof.

8. A valve assembly according to claim 7, wherein said plate member is formed adjacently to the distal end of said retainer portion with a slit-shaped aperture through which the refrigerant gas compressed in the cylinder bore may flow toward said discharge chamber.

9. A valve assembly according to claim 7, wherein said plate member is provided by a gasket plate and said discharge read valve is formed as an integral portion of a thin plate interposed between said valve plate and said gasket plate.

10. A valve assembly according to claim 7, wherein said compressor is of a multi-cylinder swash plate type refrigerant gas compressor.

11. A valve assembly in a piston type refrigerant compressor having a cylinder block assembly forming therein an axially extending cylinder bore, a reciprocable piston slidably received in said cylinder bore, a housing clamped to an axial end of said cylinder block assembly with said valve assembly therebetween and having formed therein a discharge chamber communicable with said cylinder bore, said valve assembly including a valve plate having formed therein a discharge port through which refrigerant gas compressed in the cylinder bore is forced out toward said discharge chamber, a flexible discharge reed valve attached to said valve plate on the side thereof facing the discharge chamber and arranged to normally close said discharge port and swingable about a proximal base portion thereof away from the valve plate to open said discharge port, and a plate member disposed on said discharge reed valve and having formed therein a retainer portion contactable by said discharge reed valve in its fully opened position for restricting the opening thereof, said retainer portion being formed as a raised portion of said plate member having a proximal portion and a distal portion and slanting therebetween in direction toward the discharge chamber from said proximal portion thereof which is integrally connected to the plate member so as to conform to said discharge reed valve in its fully opened position and having an opposite sides at said distal portion thereof stay portions which are integral with the plate member for rigidly holding said retainer portion in said position raised from the plate member, wherein said paired stay portions are formed progressively wider laterally outwardly substantially from said distal portion toward said proximal portion of the retainer portion.

12. A valve assembly according to claim 11, wherein said plate member is formed adjacently to the distal end of said retainer portion with a slit-shaped aperture through which the refrigerant gas compressed in the cylinder bore may flow toward said discharge chamber.

13. A valve assembly according to claim 11, wherein said plate member is provided by a gasket plate and said discharge reed valve is formed as an integral portion of a thin plate interposed between said valve plate and said gasket plate.

14. A valve assembly according to claim 11, wherein said compressor is of a multi-cylinder swash plate type refrigerant gas compressor.

15. A valve assembly in a piston type refrigerant compressor having a cylinder block assembly forming therein an axially extending cylinder bore, a reciprocable piston slidably received in said cylinder bore, a housing clamped to an axial end of said cylinder block assembly with said valve assembly therebetween and having formed therein a discharge chamber communicable with said cylinder bore, said valve assembly including a valve plate having formed therein a discharge port through which refrigerant gas compressed in the cylinder bore is forced out toward said discharge chamber, a flexible discharge reed valve attached to said valve plate on the side thereof facing the discharge chamber and arranged to normally close said discharge port and swingable about a proximal base portion thereof away from the valve plate to open said discharge port, and a plate member disposed on said discharge reed valve and having formed therein a retainer portion contactable by said discharge reed valve in its fully opened position for restricting the opening thereof, said retainer portion being formed as a raised portion of said plate member having a proximal portion and a distal portion and slanting therebetween in direction toward the discharge chamber from said proximal portion thereof which is integrally connected with the plate member so as to conform to said discharge reed valve in its fully opened position and having an opposite sides at said distal portion thereof stay portions which are integral with the plate member for rigidly holding said retainer portion in said position raised from the plate member, said plate member being formed adjacently to said distal end of said retainer portion with an elongated aperture extending laterally outwardly of said stay portions with respect to said discharge port for providing a gas passageway for guiding the refrigerant gas compressed in the cylinder bore toward said discharge chamber, wherein said elongated aperture is enlarged at the opposite ends thereof respectively in those areas thereof which are adjacent to said stay portions at the ends thereof facing toward said proximal portion of said retainer portion.

16. A valve assembly according to claim 15, wherein said plate member is provided by a gasket plate and said discharge reed valve is formed as an integral portion of a thin plate interposed between said valve plate and said gasket plate.

17. A valve assembly according to claim 15, wherein said compressor is of a multi-cylinder swash plate type refrigerant gas compressor.

* * * * *

UNITED STATES PATENT AND TRADEMARK OFFICE

CERTIFICATE OF CORRECTION

PATENT NO. : 5,226,796

DATED : July 13, 1993

INVENTOR(S) : T. Okamoto

It is certified that error appears in the above-indentified patent and that said Letters Patent is hereby corrected as shown below:

Column 1, line 10, delete "above"; line 45, "adjacently" should read --adjacent--.

Column 2, line 11, "force" should read --forced--.

Column 5, line 49, delete "being"; line 51, after "gas" insert --being--; line 52, after "Because" insert --the--.

Column 7, line 45, "opening" should read --openings--.

Column 8, line 55, "read" should read --reed--.

Column 9, line 19, after "having", "an" should read --on--.

Column 10, line 22, after "having" "an" should read --on--.

Signed and Sealed this

Seventeenth Day of May, 1994

*Attest:*

BRUCE LEHMAN

*Attesting Officer*

*Commissioner of Patents and Trademarks*